US006209932B1

(12) United States Patent
Jung et al.

(10) Patent No.: US 6,209,932 B1
(45) Date of Patent: Apr. 3, 2001

(54) MOTOR VEHICLE DOOR LOCK OR THE LIKE

(75) Inventors: Oliver Jung, Wuppertal; Siegfried Reichmann, Wermelskirchen; Bernd Allefeld, Breckerfeld; Bernd Weyerstall, Wuppertal; Berthold Huessler, Ahaus; Bernd Huster, Muenchberg; Hansjuergen Linde, Coburg; Uwe Neumann, Bamberg; Heinrich Plett, Wermelskirchen; Stefan Schwitters, Remscheid, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/147,619

(22) PCT Filed: Jun. 19, 1997

(86) PCT No.: PCT/DE97/01261

§ 371 Date: May 10, 1999

§ 102(e) Date: May 10, 1999

(87) PCT Pub. No.: WO98/05841

PCT Pub. Date: Feb. 12, 1998

(30) Foreign Application Priority Data

Aug. 2, 1996 (DE) ..... 196 31 262

(51) Int. Cl.[7] ..... E05C 3/06; E05C 3/16

(52) U.S. Cl. ..... 292/216

(58) Field of Search ..... 292/201, 216, 292/DIG. 23, DIG. 42, DIG. 43, DIG. 38

(56) References Cited

U.S. PATENT DOCUMENTS

| | | | | |
|---|---|---|---|---|
| 3,047,325 | * | 7/1962 | De Vito | 292/280 |
| 3,667,791 | | 6/1972 | Kazaoka et al. | 292/216 |
| 3,809,416 | | 5/1974 | Kazoaka | 292/216 |
| 3,923,329 | | 12/1975 | Torii et al. | 292/216 |
| 4,073,519 | * | 2/1978 | Kurozu et al. | 292/216 |
| 4,538,845 | * | 9/1985 | Yamada | 292/216 |
| 4,756,564 | * | 7/1988 | Ikeda | 292/216 |
| 4,783,103 | * | 11/1988 | Schlegel | 292/216 |
| 4,854,617 | * | 8/1989 | Hayakawa et al. | 292/216 |
| 4,880,263 | * | 11/1989 | Yamada | 292/216 |
| 4,971,373 | * | 11/1990 | Hamada et al. | 292/216 |
| 5,328,219 | * | 7/1994 | Konchan et al. | 292/216 |
| 5,438,855 | * | 8/1995 | Ikeda | 70/279 |
| 5,896,767 | * | 4/1999 | Gomi | 70/237 |
| 5,947,536 | * | 9/1999 | Mizuki et al. | 292/201 |
| 6,062,613 | * | 5/2000 | Jung et al. | 292/201 |

* cited by examiner

*Primary Examiner*—Lynne H. Browne
*Assistant Examiner*—John B. Walsh
(74) *Attorney, Agent, or Firm*—Nixon Peabody LLP; David S. Safran

(57) ABSTRACT

A motor vehicle door lock or the like has a housing (1) or a lock bearing plate, a rotary latch (2) with a jaw (3) for a locking wedge (4) or lock bolt and a pawl (7) for locking the rotary latch (2) in a locking position which corresponds to the closed motor vehicle door. Several complementary measures are proposed which can be applied together or separately to optimise the locking elements—rotary latch (2) and pawl (7). A differentiated positioning of the rotary latch (2) and pawl (7) is particularly significant. The material, shape and/or mounting of the swivelling axis (10) of the rotary latch (2) or of the swivelling axis (20) of the pawl (7) are designed for normal operation conditions. However, in the event of tearing up forces which are considerably higher than the normal operation conditions (crash), the rotary latch (2) or pawl (7) can be displaced in such a way that a substantial proportion of the tearing up forces can be absorbed by the supporting area of a recess (11) which contains the rotary latch (2) or of a recess (21) which contains the pawl (7).

13 Claims, 5 Drawing Sheets

MOTOR VEHICLE DOOR LOCK OR THE LIKE

The invention relates to a motor vehicle door lock or the like with the features of the preamble of claim 1.

BACKGROUND OF THE INVENTION

1. Field of the Invention

The invention relates to a motor vehicle door lock having a lock carrier such as a housing or lock plate, a rotary latch in the form of a disk with a receiving opening for a key collar or a locking pin, and with a detent pawl for locking the rotary latch in a locked position which corresponds to a closed motor vehicle door.

2. Description of Related Art

Classical motor vehicle door locks use a rotary latch which is made as a fork latch, which is made solid, and which is pivotally mounted as a swivel axle on a journal which is fixed in the housing or on the lock carrying plate published German Patent Application Nos. -A-29 36 997, DE-A-32 42 527). In the closed position of the motor vehicle door the fork latch secures the forward leg of a key collar or a locking pin with the receiving opening so that the motor vehicle door cannot spring open even when high tearing forces occur in a crash. The fork latch itself is fixed in this closed position by a detent pawl which is tensioned or compressed via locking surfaces which engage one another (main catch).

In the above explained known construction the tearing forces in case of a crash engage the rotary latch via a relatively large lever arm and the latch must be made rather bulky. The same applies to the detent pawl which holds the rotary latch and which must accommodate most of the tearing forces as a result of the existing lever ratios.

The prior art discloses, as an alternative to a fork latch, making the rotary latch as a disk of solid material published German Patent Application No. -C-16 78 121). In this case, the rotary latch is pivotally supported in a recess which has a peripheral surface which adjoins the rotary latch and forms the guide of the latter. A journal which forms the swivel axle is not present in the middle of the rotary latch. The swivel axle of the rotary latch is only virtually formed. The rotary latch is fixed axially by the bottom surface of the recess and by a cover, in the area of the center point of the rotary latch on the cover there being an impression which limits the sliding friction between the rotary latch and the cover at the center point. The lever ratios in this alternatively built rotary latch are in principle for the most part exactly as in the above explained fork latch.

Rotary latches, especially in the form of fork latches, have already been made as composite parts from metal and plastic published German Patent Application No. -A-06 69 437). This is done primarily by a base body which represents the fork latch itself being made of metal which is then provided with a plastic extrusion coating. This is intended to form the bearing, attenuate noise, prevent metal/metal contact, etc. In the course of extrusion coating with plastic in particular recesses can also be made especially on the peripheral surface of the rotary latch either to make elastic attenuation buffers or to be able to execute switching functions in conjunction with microswitches in the housing of the motor vehicle door lock. Other areas, especially areas which in case of a crash are exposed to high tearing forces, in the meantime remain free of the plastic jacketing. This applies especially to the main catch of the rotary latch on which the detent pawl keeps the rotary latch in the closed position.

Generally, in the prior art it is found that the locking parts, i.e. the rotary latch and the detent pawl, as in the other areas of the motor vehicle door lock, are designed for crashes; this entails over dimensioning and in any case is not an optimal configuration for the normal case of operation. For example, in the rotary latch this means that in it there is a bearing opening for the bearing pin which is fixed on the housing, which forms the swivel axle, and which has a large diameter designed for crashes. The rotary latch itself is however relatively narrow, and is generally only a few millimeters wide. The bearing surface on the bearing pin which forms the swivel axle is therefore rather narrow. A lateral inclination of the rotary latch in the case of a crash under the action of high tearing forces therefore represents a major problem. This problem has been recognized and has lead to the rotary latch being coupled in the axial direction to the detent pawl by profiling in the engagement area published German Patent Application No. -A-18 12 528).

The aforementioned makes it clear that the rotary latch as one of the most important parts of a motor vehicle door lock or the like has not been adequately analyzed so far with respect to the stress field between operating safety (especially in case of a crash) on the one hand and production cost on the other.

The similar applies to the detent pawl of the known motor vehicle door locks or the like. It is generally swivel mounted on a bearing pin which is parallel to the bearing pin of the rotary latch. All the tearing forces in case of a crash, to the extent they are diverted via the detent pawl, are diverted by the detent pawl into the bearing pin and from there into the housing or the lock carrying plate. This is independent of whether the detent pawl is tensioned or compressed.

The aforementioned makes it clear that in existing motor vehicle door locks the optimized configuration of the locking parts, i.e. the rotary latch and the detent pawl, has not yet been adequately considered. This has led to the fact that the rotary latch and the detent pawl have been more and more dramatically overdimensioned with increasing demands for operating safety, especially operating safety in case of a crash. Attempts have been made to accommodate the tearing forces in case of a crash by a large undercut angle between the detent pawl and the rotary latch. This in turn has had an adverse effect on the opening forces between the rotary latch and the detent pawl.

SUMMARY OF THE INVENTION

It follows from the explanations above that the teaching of this patent application is directed at the problem of devising a motor vehicle door lock or the like in which the locking parts, i.e. the rotary latch and the detent pawl, have been substantially improved with respect to operating safety and production cost.

The aforementioned object is achieved in a first alternative in a motor vehicle door lock having a lock carrier, a rotary latch in the form of a disk with a receiving opening for one of a key collar and a locking pin, and with a detent pawl for locking the rotary latch in a locked position which corresponds to a closed motor vehicle door; wherein the rotary latch is pivotally mounted on an axle on the lock carrier; by the rotary latch being located in a recess of the lock carrier which at least partially surrounds the rotary latch; by a peripheral surface of the rotary latch having at least one contact section; by a surface section on a peripheral surface of said recess being arranged such that the contact section of the rotary latch is opposite said surface section in a blocked position; by the position of the contact section and surface section in the blocked position of the rotary latch being such that a vector of action of tearing forces which may occur has an important force component which crosses the contact section and surface section; and by the axle being of a material, shape and support, which allows displacement of the rotary latch when tearing forces occur which are much higher than occur during normal operation such that the tearing forces are largely captured over a resultant contact area between the contact section and the surface section.

Here the rotary latch is at the focus of interest. It is provided in accordance with the invention that instead of one bearing arrangement of the rotary latch provided for normal operation and a crash, there are two bearing arrangements. One bearing arrangement supports and guides the rotary latch in normal operation, and the other bearing arrangement captures the rotary latch in case of a crash. This makes it possible to restore the dimensioning of the rotary latch which had been done for the case of a crash to dimensioning for the normal case. The function of accommodating forces in case of a crash is transferred to the recess in the housing or to the lock carrying plate. Normally therefore the forces are accommodated via the swivel axle of the rotary latch which can have a correspondingly small diameter. Consequently, rotation of the rotary latch can take place with little friction. In the case of a crash on the other hand the force is routed from the rotary latch itself via the contact area directly into the housing or the lock carrying plate of the motor vehicle door lock.

The advantage of the above explained teaching lies in that the rotary latch can be made smaller, its mass reduced and it can be made lighter overall; this greatly reduces production costs. At the same time operating safety is even increased since this corresponds roughly to operating safety in case of a crash which in the past could only be achieved by disk-shaped rotary latches with their large contact surfaces. At the same time, for normal operation the extremely low-friction axial bearing arrangement on the physically present swivel axle of small diameter is formed.

The above explained teaching of the invention finds further embodiments. In particular, within the framework of this teaching the embodiment of the rotary latch as a disk, as is known from the prior art, is a major advantage. In this way the contact area can be formed without especially expensive configuration measures.

According to another teaching of the invention of independent importance, which however can be used especially advantageously in conjunction with the above explained teaching of the invention, the swivel axle is fixed in or on the rotary latch and supported outside of the latter. Thus the bearing surface of the rotary latch is widened several-fold, generally roughly to three times the previous width. This leads to the rotary latch being guided much better in the axial direction than in the past. This can otherwise be done especially feasibly when in this swivel axle there is only one such swivel axle which is used solely for normal operation with small diameter and relatively low strength.

By the rotary latch having a ring-shaped outer part made of a high strength material and an inner part which is located therein and which is made of plastic, production cost is greatly reduced by substantially changing and increasing the proportion of plastic in the rotary latch. Differently than in rotary latches of the prior art which are provided with plastic molded attachments or which are extrusion-coated with plastic, here the proportion of plastic of the rotary latch is substantially increased by producing the internal part of the rotary latch out of plastic. Analysis of force directions has shown that the forces can be adequately directed via the metal outer part into the detent pawl while the force direction components absorbed by the rotary latch itself can be adequately routed into the outer part via the plastic inner part.

In terms of production engineering there is the major advantage that the high tolerance requirements in punching and jacketing of rotary latches of the prior art are eliminated and they are assigned to the plastic inner part which is easy to insert. A plastic molding can however fundamentally be produced much more exactly with stipulation of a certain production cost than existing composite elements.

Finally, another teaching of the invention acquires independent importance; it likewise relates to the configuration of the rotary latch. This is the teaching that a profiled molding is used to form the rotary latch which with the same mass reaches a higher resistance moment than in the past.

In the following the invention is detailed using drawings which show simply embodiments

DETAILED DESCRIPTION OF THE INVENTION

Figure 1:
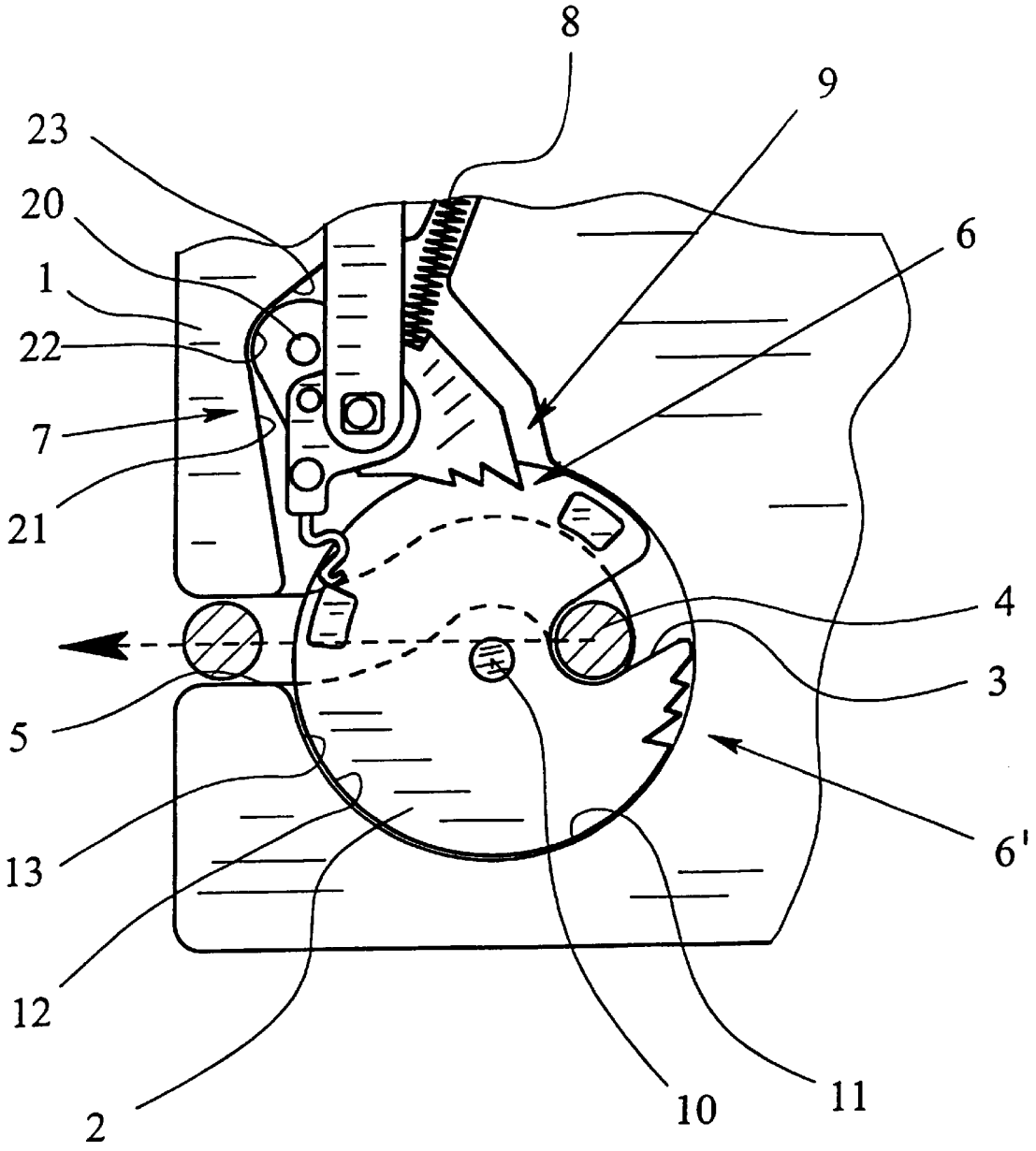
FIG. 1 shows a first embodiment of a motor vehicle door lock in accordance with the invention in a schematic view.

FIG. 1 shows a motor vehicle door lock for the side door of a motor vehicle. In the understanding of the teaching of this patent application reference can be made to the statements at the start of the specification for the concept of motor vehicle door lock.

FIG. 1 shows first of all in a housing 1 or on a lock carrying plate a rotary latch 2 with a receiving opening 3 for the forward leg of a key collar 4. Instead of a key collar 4 which has two legs, there can of course also be a locking pin which represents only one leg.

In housing 1 there is an inlet slot 5 for the key collar 4.

The rotary latch 2 on its main catch has a locking surface 6. In this embodiment the rotary latch 2 moreover has a locking surface 6' also on a preliminary catch. For hood locks there are for example versions without a preliminary catch.

A pivotally mounted detent pawl 7 is pretensioned by a spring element 8 or the like in the engagement direction and has a counterlocking surface 9 with which it engages the locking surface 6 or 6' on the rotary latch 2 for purposes of locking in the main catch or in the preliminary catch.

According to the first teaching of the invention it is provided that the rotary latch 2 is pivotally mounted with a physically present swivel axle 10 on the housing 1 or on the lock carrying plate. The rotary latch 2 is located in a recess 11 which at least partially surrounds the rotary latch 2 in the housing 1 or on the lock carrying plate. On the rotary latch 2 on the peripheral surface at least one contact section 12 is formed. One section 13 on the peripheral surface of the recess 11 is arranged such that the contact section 12 of the rotary latch 2 is opposite this section 13 in the locked position (this is the case in FIG. 1). The position of the contact section 12 and section 13, the contact area, in the locked position of the rotary latch 2 is such that the vector of the action of tearing forces which may occur, at least one major component of this force action vector, crosses the contact area.

The swivel axle 10 of the rotary latch 2 is designed for normal operation in terms of material, shape and/or support, however when tearing forces occur which are much higher than in the case of normal operation (crash) it allows displacement of the rotary latch 2 such that the tearing forces are largely captured over the contact area. The advantages of this differentiated support of the rotary latch 2 have been explained in the general part of the specification. FIG. 1 shows that the diameter of the swivel axle 10 which need only accommodate the forces in a normal case can be accordingly small. The friction forces which occur when the rotary latch 2 turns around the swivel axis 10 are also accordingly low. This is a major advantage in normal operation.

The action vector for tearing forces in case of a crash is shown by the broken line in FIG. 1. It is apparent that it lies in the area ofthe inlet slot 5 between the two contact areas so that the tearing forces are transferred to these two contact areas. The detent pawl 7 is stressed only comparatively little in this case because the rotary latch 2 is made as a disk and in this embodiment the key collar 4 in the locked position lies directly on the action line of the tearing forces which occur in operation, which line runs through the swivel axle 10. But the teaching of the invention can be implemented not only in this concept and arrangement, but in general for rotary latches 2, even in those in the form of a fork latch with a larger lever arm (explanation in the general part of the description). This is detailed below.

For the teaching of the invention it can be now provided that the swivel axle 10 and/or the support of the swivel axle 10 be permanently deformed or destroyed in case of a crash. But it also holds as a preferred alternative and thus also as provided in the embodiment that the swivel axle 10 of the rotary latch 2 be made elastic and/or be supported such that the rotary latch 2 is reversibly displaced transversely to the swivel axle 10 when considerable forces occur. In particular this embodiment can be well understood in conjunction with FIG. 2*a* of the drawings in which the double arrow indicates the displacement possibility of the swivel axle 10.

Figure 2A:
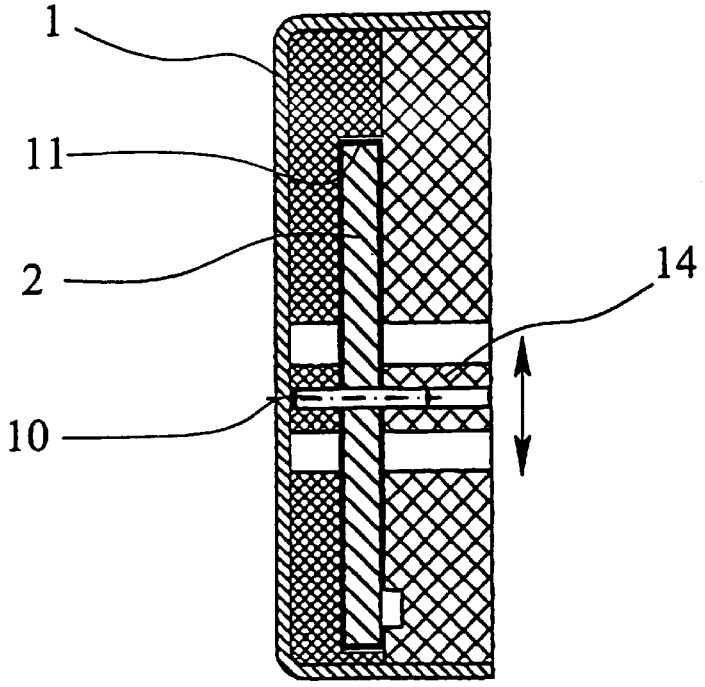
FIG. 2 shows a section through the motor vehicle door lock from FIG. 1 in the area of the rotary latch (2*a*) and the detent pawl (2*b*)

Since the tearing forces in case of a crash are accommodated due to support of the rotary latch 2 on very large surfaces, which is accomplished as claimed in the invention, and are diverted into the housing 1 or the lock carrying plate, the surface load is much less than in the known receiver over a corresponding bearing pin. Consequently the recess 11 in the housing 1 or on the lock carrying plate can optionally be made even of plastic. This is shown in FIG. 2a.

Figure 2B:
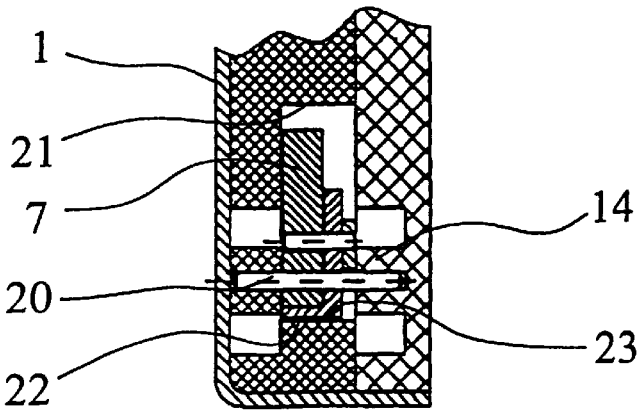

FIG. 2*b* in conjunction with FIG. 1 shows a corresponding approach for the detent pawl 7. It is provided that the detent pawl 7 is pivotally mounted with a physically present swivel axle 20 on the housing 1. But the detent pawl 7 is moreover also located in this partially surrounding recess 21 in the housing. On the detent pawl 7 on the peripheral surface there is a contact section 22 (also indicated in FIG. 2*b*) opposite a section 23 on the peripheral surface of the recess 21 in the locked position. A corresponding effect in case of a crash, as explained above for the rotary latch 2, is the consequence. The support forces of the detent pawl 7 are therefore diverted into the housing 1 via large force transfer surfaces. This has the advantages explained above for the rotary latch 2 in the corresponding manner for the detent pawl 7.

Figure 3:
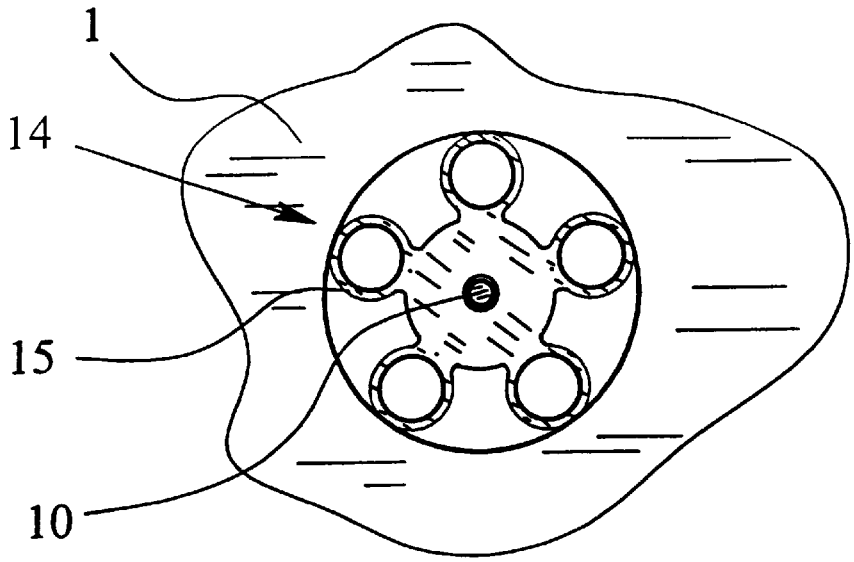
FIG. 3 shows the middle area of the rotary latch from FIG. 1 with the axle bearing there.

FIG. 3 furthermore shows that the swivel axle 10 of the rotary latch 2 is supported in a plastic bearing 14 with elastically deformable bearing bodies 15. With this construction a specific design of the support of the swivel axle 10 of the rotary latch 2 is presented. The bearing bodies 15 of the plastic bearing 14 are hollow and can be deformed under loads which lie transversely to the axle direction, but after disappearance of the forces which occur they return to their original position. In this way the swivel axle 10 is also returned to the original position after a crash. A corresponding plastic bearing 14 is shown in FIG. 2*b* otherwise also for the detent pawl 7 with the corresponding advantages. If not subjected to deformations elsewhere, the motor vehicle door lock of the design as claimed in the invention is again serviceable after a crash.

In this embodiment it is provided that the swivel axle 10 or 20 is a metal axle. But it could also consist of plastic which is for example the case in the embodiment from FIG. 7.

Figure 4:
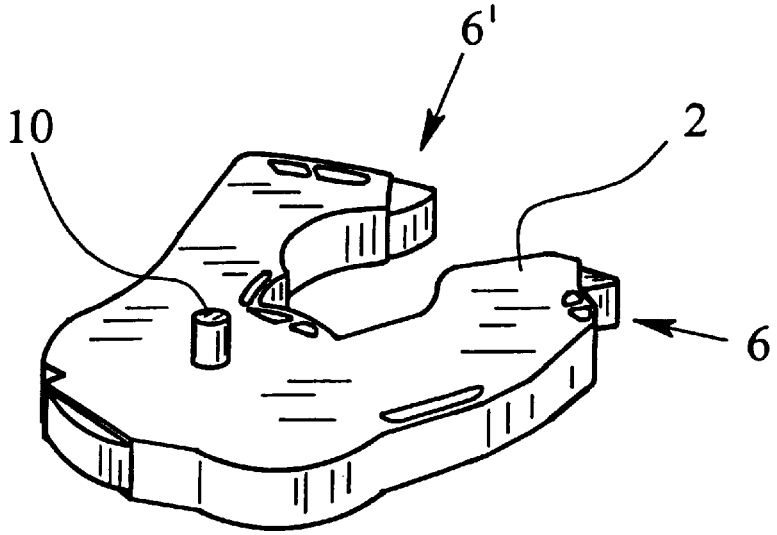
FIG. 4 shows in a perspective view a rotary latch made as a fork latch with integrated swivel axis.

Basically the above explained teaching ofthe invention allows arrangement ofthe swivel axle 10 in the classical manner with a rotary bearing in the rotary latch 2. But it applies according to one preferred teaching which can be recognized in the embodiment of FIG. 4 that the swivel axle 10 is fixed in or on the rotary latch 2, projects on either side from the rotary latch 2 and is supported on the housing 1 or on the lock carrying plate. This has the advantages explained in the general part ofthe description with respect to location and guidance ofthe rotary latch 2 relative to laterally directed forces. This also applies as one configuration possibility in the corresponding manner to the detent pawl 7, as can be taken from FIGS. 2*a* and 2*b*.

Figure 5:
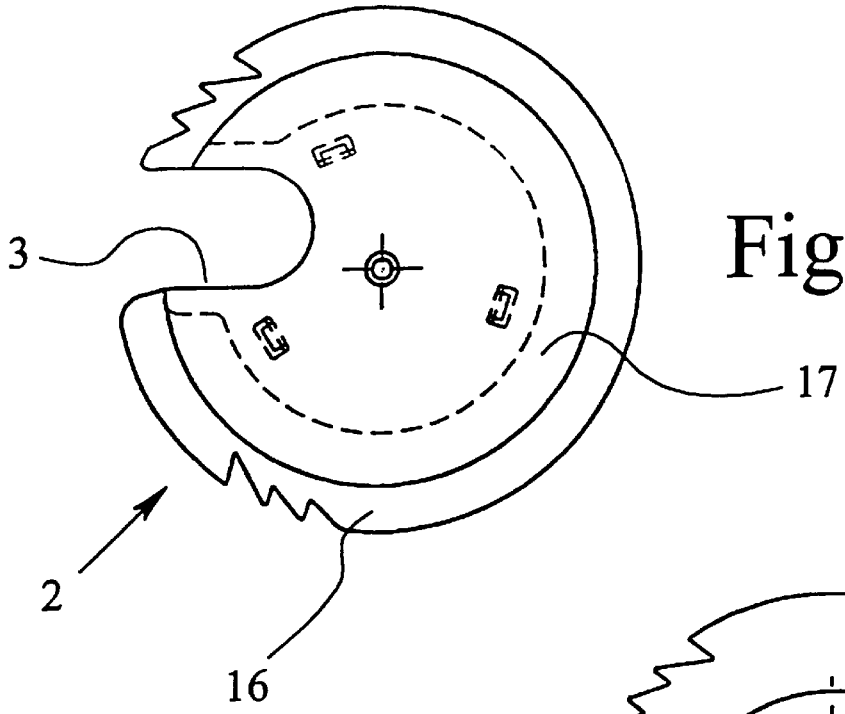
FIG. 5 shows one embodiment of a specially configured rotary latch consisting of several parts.
Figure 6:
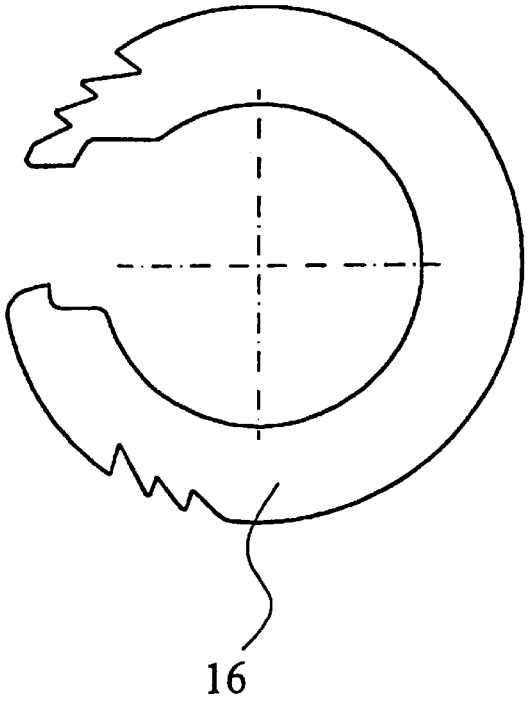
FIG. 6 shows the outer part of the rotary latch from FIG. 5.
Figure 7:
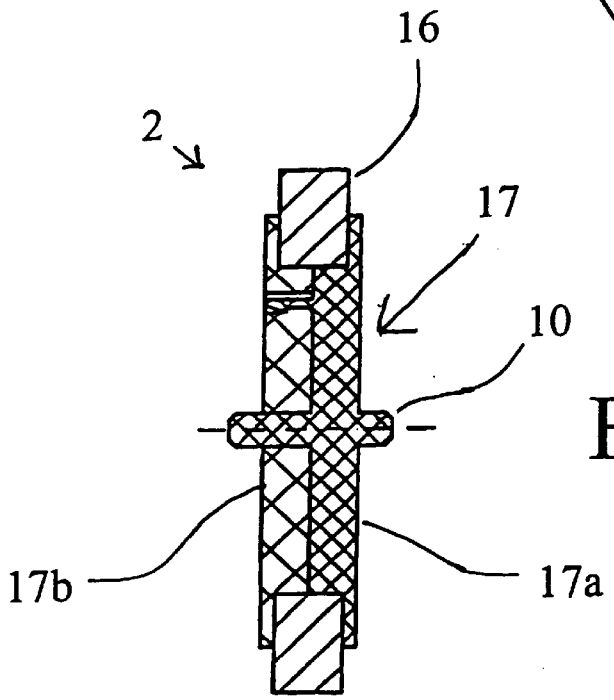
FIG. 7 shows a section through the rotary latch from FIG. 5.

The embodiment which is detailed in FIGS. 5, 6, and 7 is characterized by another teaching of the invention, specifically by the rotary latch 2 consisting of a ring-like outer part 16 which consists of high resistance material and an inner part 17 which is located therein and which consists of plastic. In this embodiment as well according to the preferred teaching the rotary latch 2 is again made as a disk. Here it is provided that the outer part 16 consists of metal, particularly of steel. The force transfer area between the rotary latch 2 and the detent pawl 7 is therefore made of metal, the inner area with optionally complicated recesses provided there in the inner part 17 consists of plastic.

Basically it would also be conceivable in further development of the teaching for the outer part 16 to consist of high resistance material, not metal, but for example of a high strength, fiber reinforced plastic. The outer part 16 could also consist of sinter material.

In this embodiment, especially easily recognizable in FIG. 7, the inner part 17 consists of several individual parts 17*a*, 17*b*. The inner part 17 could be clipped into the outer part 16; this is very feasible in terms of production engineering. But it is provided in this embodiment that the two individual parts 17*a*, 17*b* of the inner part 17 are clipped to one another with the interposition of the outer part 16. The recesses used for clipping are implemented in this way in the individual parts 17*a*, 17*b* of the inner part 17; this has advantages for production engineering. FIG. 7 shows the implementation of the swivel axle 10 as an integrated axle consisting of plastic in the individual part 17*a* of the inner part 17.

For the detent pawl 7 corresponding configurations can be easily imagined, for example the ratchets of the detent pawl 7 which has the counterlocking surface 9 should feasibly be made of metal.

Figure 8:
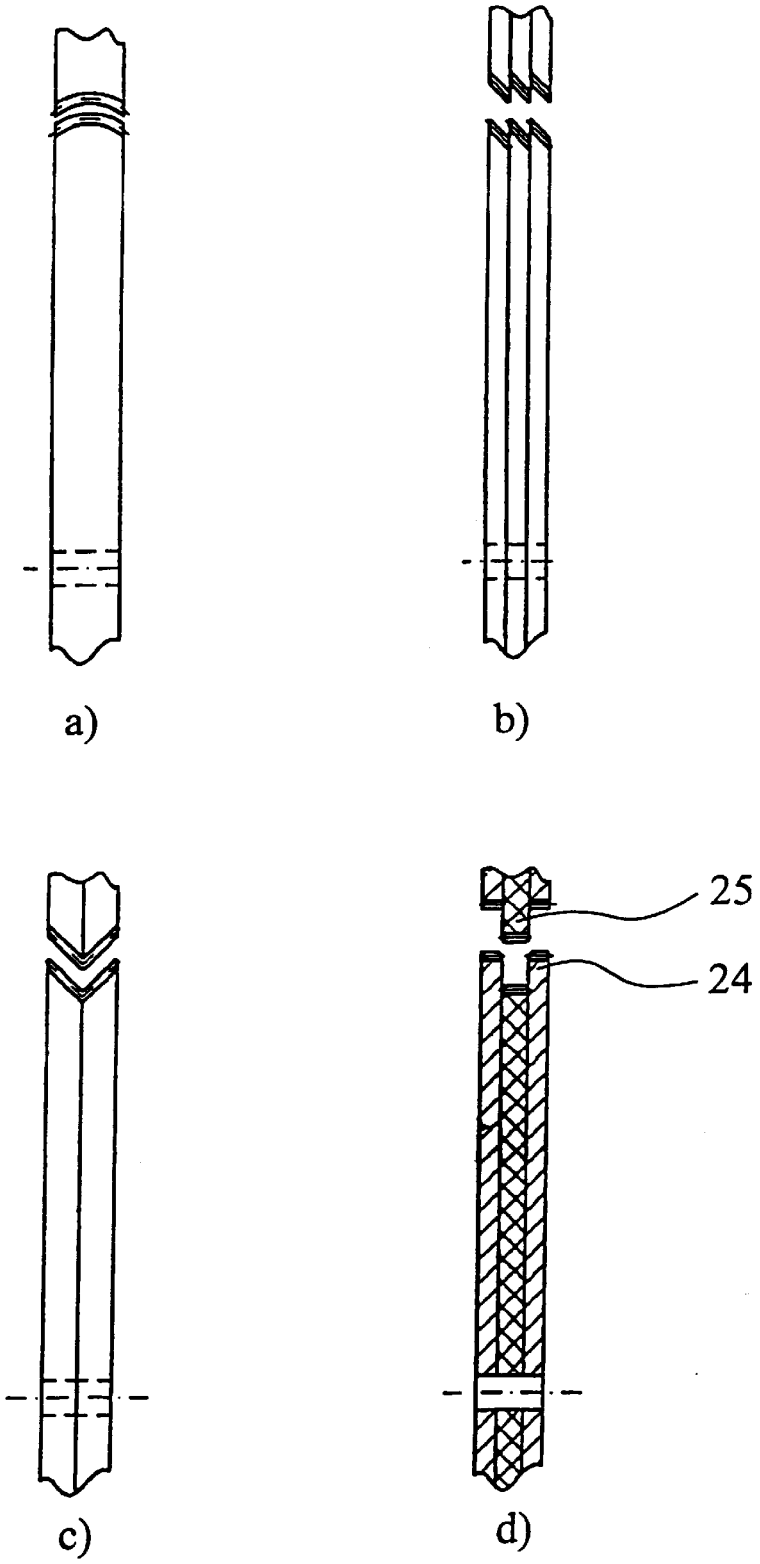
FIG. 8 shows another embodiment of a rotary latch in accordance with the invention in a section.

FIG. 8 shows another teaching of the invention which with respect to the rotary latch 2 likewise leads to a reduction of production costs. Here it is specifically provided that, see FIG. 8*d*, the rotary latch 2 is made in a sandwich design, especially with a metal/plastic/metal layer sequence. Here it can be taken from FIG. 8 that the engagement surface of the rotary latch 2 and the detent pawl 7 on the locking surfaces 6, 9 is profiled in the axial direction, therefore in the direction of the swivel axle 10, such that the detent pawl 7 engages the rotary latch 2 in the axial direction here by form-fit. This is known from the prior art (see the introductory part of the description), but can be accomplished especially feasibly with the sandwich approach of the invention. The sandwich approach, as is shown especially in FIG. 8*d*, allows formation of form-fitting configurations 24, 25 in the engagement area of the rotary latch 2 and the detent pawl 7 simply by different dimensioning of the layers of the layer sequence.

FIG. 8*a* shows otherwise a rotary latch 2 not made using the sandwich technique and detent pawl 7, FIG. 8*c* shows a construction made with only two layers. In any case it applies that via the fixing achieved through the wider support of the rotary latch 2 and optionally the detent pawl 7 using this technique lateral slippage ofthe detent pawl 7 away from the rotary latch 2 is made difficult. This increases the operating safety in normal operation and especially in case of a crash.

Above and beyond the aforementioned explanations on the detent pawl 7 it applies quite generally that the approaches presented above for the rotary latch 2 using various embodiments can be used accordingly also for the detent pawl 7.

What is claimed is:

1. Motor vehicle door lock comprising a lock carrier, a rotary latch in the form of a disk with a receiving opening for one of a key collar and a locking pin, and with a detent pawl for locking the rotary latch in a locked position which corresponds to a closed motor vehicle door; wherein the rotary latch has a ring-shaped outer part made of a high strength material and an inner part which is located therein and which is made of plastic.

2. Motor vehicle door lock as claimed in claim 1, wherein the outer part is made of metal.

3. Motor vehicle door lock as claimed in claim 2, wherein the metal is steel.

4. Motor vehicle door lock as claimed in claim 1, wherein the inner part is comprised of several individual parts.

5. Motor vehicle door lock as claimed in claim 4, wherein the individual parts of the inner part are clipped together with the interposition of the outer part.

6. Motor vehicle door lock as claimed in claim 1, wherein the inner part is clipped into the outer part.

7. Motor vehicle door lock as claimed in claim 1, wherein the rotary latch has a pivot axis formed by an axle made on the inner part.

8. Motor vehicle door lock as claimed in claim 1, wherein said lock carrier is a housing.

9. Motor vehicle door lock comprising a lock carrier, a rotary latch in the form of a disk with a receiving opening for one of a key collar and a locking pin, and with a detent pawl for locking the rotary latch in a locked position which corresponds to a closed motor vehicle door; wherein the rotary latch is made of a sandwich construction with a metal-plastic-metal layer sequence.

10. Motor vehicle door lock as claimed in claim 9, wherein the detent pawl also has a sandwich construction with a metal-plastic-metal layer sequence; and wherein the rotary latch and the detent pawl, in an engagement area, engage one another via form-fitted recesses; and wherein the form-fitted recesses are formed by different dimensions of the layers in the layer sequences.

11. Motor vehicle door lock as claimed in claim 9, wherein said lock carrier is a housing.

12. Motor vehicle door lock comprising a lock carrier, a rotary latch in the form of a disk with a receiving opening for one of a key collar and a locking pin, and with a detent pawl for locking the rotary latch in a locked position which corresponds to a closed motor vehicle door; wherein the detent pawl has a ring-shaped outer part made of a high strength material and an inner part which is located therein and which is made of plastic.

13. Motor vehicle door lock comprising a lock carrier, a rotary latch in the form of a disk with a receiving opening for one of a key collar and a locking pin, and with a detent pawl for locking the rotary latch in a locked position which corresponds to a closed motor vehicle door; wherein the detent pawl is made of a sandwich construction with a metal-plastic-metal layer sequence.

* * * * *